US006721981B1

(12) United States Patent
Greenhalgh et al.

(10) Patent No.: US 6,721,981 B1
(45) Date of Patent: Apr. 20, 2004

(54) BODY SUPPORT APPARATUS

(76) Inventors: Colin Jack Greenhalgh, Greystones, Paulton Road, Hallatrow, Bristol BS39 6EG (GB); Marlene Claire Greenhalgh, Greystones, Paulton Road, Hallatrow, Bristol BS39 6EG (GB)

( * ) Notice: Subject to any disclaimer, the term of this patent is extended or adjusted under 35 U.S.C. 154(b) by 0 days.

(21) Appl. No.: 09/787,755

(22) PCT Filed: Sep. 17, 1999

(86) PCT No.: PCT/GB99/03095

§ 371 (c)(1),
(2), (4) Date: Mar. 21, 2001

(87) PCT Pub. No.: WO00/16664

PCT Pub. Date: Mar. 30, 2000

(30) Foreign Application Priority Data

Sep. 24, 1998 (GB) ..... 9820729

(51) Int. Cl.[7] ..... A47C 23/04

(52) U.S. Cl. ..... 5/716; 5/253; 5/258; 5/719; 5/264.1; 5/731; 5/726

(58) Field of Search ..... 5/613, 241, 243, 5/253, 258, 261, 264.1, 716, 731, 900.5, 244, 260, 252, 935, 719, 423, 726; 267/85, 95, 100, 103

(56) References Cited

U.S. PATENT DOCUMENTS

| | | | | | |
|---|---|---|---|---|---|
| 66,849 | A | * | 7/1867 | Johnson | 5/248 |
| 1,475,010 | A | | 11/1923 | Garbutt | |
| 3,031,690 | A | * | 5/1962 | Ramsay | 267/94 |
| 3,266,064 | A | * | 8/1966 | Figman | 5/284 |
| 3,656,190 | A | * | 4/1972 | Regan et al. | 5/600 |
| 4,222,137 | A | | 9/1980 | Usami | |
| 4,965,898 | A | * | 10/1990 | So | 297/452.48 |
| 5,060,326 | A | | 10/1991 | Oswald | |
| 5,332,202 | A | * | 7/1994 | Wagner et al. | 267/82 |
| 5,446,933 | A | | 9/1995 | Gabelhouse | |
| 5,588,165 | A | | 12/1996 | Fromme | |

FOREIGN PATENT DOCUMENTS

| | | |
|---|---|---|
| AT | 383 260 | 6/1987 |
| DE | 89 05 104 | 9/1989 |
| DE | 93 12 069 | 10/1993 |
| GB | 2 178 307 | 2/1987 |
| GB | 2290 225 | 12/1995 |
| WO | 89/01749 | 3/1989 |
| WO | 90/14032 | 11/1990 |

* cited by examiner

*Primary Examiner*—Michael F. Trettel
(74) *Attorney, Agent, or Firm*—Pitney, Hardin, Kipp & Szuch LLP

(57) ABSTRACT

A body support apparatus, for example, a bed, includes a support surface defined by support members. Each support member is mounted for movement in a direction substantially normal to the support surface. Support members are so arranged that movement of any one of the support members in a direction substantially normal to the support surface and beyond a threshold distance relative to an adjacent support member causes movement in substantially the same direction of said adjacent support member. No movement of a support member is caused by the movement of an adjacent support member when the distance of relative movement is below the threshold distance. The support members are resiliently urged towards an unloaded position, by tension springs.

15 Claims, 11 Drawing Sheets

BODY SUPPORT APPARATUS

Figure 1:
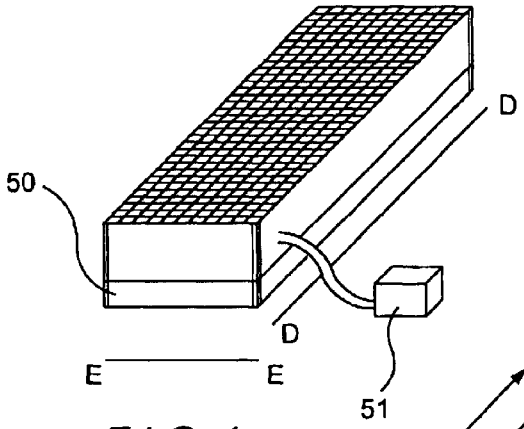

The present invention relates generally to a body support apparatus, that is, an apparatus suitable for supporting at least part of a living human being. In particular the invention relates to a bed, but also has application to chairs and other apparatus for supporting a person, or part of a person (for example, just their legs).

Beds of the prior art commonly comprise a mattress that supports the body, the mattress conforming, at least to a limited extent, to the shape of the person lying on the bed. A purpose of the mattress is to provide comfort by supporting the body, whilst avoiding having parts of the body in contact with the mattress being exposed to points of high pressure. Conventional mattresses have certain disadvantages however.

One such disadvantage is that dust and other matter can accumulate within the mattress thereby providing a suitable environment for dust mites to live in. (There has been evidence to suggest a link between the presence of dust mites within mattresses and the provocation of asthma attacks in those susceptible to such attacks.) Furthermore, conventional mattresses are generally heavy, generally difficult to clean and can be expensive to replace.

There are beds of the prior art such as, for example, water beds that do not require the provision of a conventional mattress, thereby avoiding at least some of the above-mentioned disadvantages associates with such mattresses. Water beds however suffer from other disadvantages. For example, water beds can leak. Also water beds suffer from the undesirable effects of "ballooning", that is, when one region of the bed is depressed another region rises owing to the volume of water being substantially constant and "wave motion", where the surface of the bed can continue to move owing to wave-like motion of the water in the bed. Both ballooning and wave motion can reduce the comfort of the user or users of the bed.

Attempts have been made in the prior art to provide a bed which does not require a conventional mattress and which also does not suffer from at least some of the above-mentioned disadvantages associated with water beds. One such attempt is described in U.S. Pat. No. 5,446,933. U.S. Pat. No. 5,446,933 discloses a bed comprising an array of vertically arranged dowels, which are able to move vertically, and which define a body supporting surface. The bottoms of the dowels interact with a flexible fluid chamber and downward pressure exerted on the chamber by any of the dowels is transmitted via the fluid to the other dowels and additionally to a pressure counterbalance that is displaceable by the fluid according to the fluid pressure. The bed of U.S. Pat. No. 5,446,933 whilst reducing the ballooning effect found in water beds still suffers from at least some of the other above-mentioned disadvantages associated with water beds.

It is an object of the present invention to provide a body support apparatus that mitigates at least some of the above-mentioned disadvantages associated with the body support apparatuses of the prior art.

Accordingly, the present invention provides a body support apparatus comprising a support surface defined by support members, each support member being mounted for movement in a direction substantially normal to the support surface, wherein at least a multiplicity of the support members are so arranged that movement of any one of those support members in a direction substantially normal to the support surface and beyond a threshold distance relative to an adjacent support member causes movement in substantially the same direction of said adjacent support member, there being substantially no movement of said adjacent support member caused by the movement of said any one of those support members when the distance of relative movement is below the threshold distance and a plurality of said multiplicity of support members are resiliently urged towards an unloaded position.

The body support apparatus can be used without the provision of a thick mattress and yet without prejudicing comfort, because the support surface defined by the support members conforms substantially to the shape of the body of the user, by means of the combined effects of the resiliently movable support members and the way in which the multiplicity of support members move in relation to each other.

Furthermore the body support apparatus need not rely on water or other fluids to make the apparatus comfortable to use and so the apparatus need not be prone to leaks of such fluids. Also the apparatus can easily be configured so that movement of one support member in one direction does not cause movement of another support member in an opposite direction. Thus the apparatus need not suffer from the affects of "ballooning". Moreover, since a support member must move more than a threshold distance in order to cause movement of an adjacent support member "wave motion" can be reduced, if not eliminated. Also the apparatus when used as a bed by two people need not suffer from the "roll together" effect (where the weight of one person causes the support surface to incline towards that person to such an extent that the support surface in the region of the second person becomes inclined and urges, by gravity, the second person towards the first person, causing the two people to "roll together").

It should be understood that where the term "body support apparatus" is used herein with reference to the present invention the term includes within its scope beds, chairs and other apparatus capable of supporting a living human being or an animal having a mass greater than 1 Kg or a part of such a human being or animal.

For the sake of convenience a support member, which is so arranged that movement of it in a direction substantially normal to the support surface and beyond a threshold distance relative to an adjacent support member causes movement in substantially the same direction of said adjacent support member (there being substantially no movement of said adjacent support member caused by the movement of the first mentioned support member when the distance of relative movement is below the threshold distance) shall hereinafter be referred to as an "active support member".

Preferably the apparatus comprises more than 250 support members.

The respective threshold distances in relation to pairs of adjacent active support members are conveniently substantially the same. The distance of relative separation between a pair of adjacent active support members may conveniently be limited, in that there may be a maximum distance of separation between adjacent support members during normal use of the apparatus. The maximum distance of separation between a pair of adjacent active support members may be dependent on the threshold distance associated with that pair of support members. When all of the support members in a region are active support members and there is such a maximum distance of relative separation between pairs of adjacent active support members, a maximum angle of inclination of the support surface in that region may be predetermined by selecting appropriate threshold distances.

Preferably the apparatus is so arranged that the angle of inclination of the support surface relative to the support surface when unloaded is limited to a maximum angle.

Preferably that maximum angle is between 5 and 45 degrees and more preferably between 10 and 30 degrees.

Preferably all of the multiplicity of support members are resiliently urged towards an unloaded position. Preferably, each of a plurality of the resiliently urged support members are directly resiliently urged towards an unloaded position, for example, by means of a respective resilient device. Not all of the resiliently urged active support members need to be directly resiliently urged as can be illustrated as follows. Consider an apparatus according to the present invention, including first and second adjacent active support members, only the second of which is directly resiliently urged by, for example, a spring. When the first active support member moves beyond its threshold distance it will cause movement of the second member and will then be subjected to the resilient bias of that second member towards its unloaded position. Preferably, all of the active support members are resiliently urged, either directly or indirectly.

The support members that are directly resiliently urged towards an unloaded position may each be so configured that the return force increases continuously with the distance of the support member from the unloaded position.

Preferably, less than two thirds, for example about a half, of the active support members are directly resiliently urged towards an unloaded position.

Preferably, each of a plurality of the resiliently urged support members are directly resiliently urged towards an unloaded position by a respective spring, advantageously a tension spring. It will be understood that in the present context a "tension spring" is a spring that is configured to provide a returning force when extended. For example, movement of a support member associated with such a tension spring away from its unloaded position, caused by for example the body of a person exerting a downward force onto the support surface, causes that tension spring to extend thereby providing a force equal and opposite to the downward force on the support member. Whilst compression springs (as commonly used in conventional mattresses) could be used, it has been found that an apparatus using tension springs generates less noise, when the support members move in use, than a similar apparatus using compression springs.

The apparatus is preferably arranged so that each of the resiliently urged support members is prevented from reaching its unloaded position. Each of the resiliently urged support members may therefore always be loaded (subjected to a return force) even when in its rest position (the position at which the support member rests when there are no external loads). For example, each of the resiliently urged support members may be associated with stop means that restricts the movement of the resiliently urged support member. Preferably, each of the resiliently urged support members is associated with a respective stop. The provision of a stop or stop means has several advantages: manufacture of the apparatus may be made easier; the apparatus may be so configured that the support members can not easily be pulled out of the apparatus; and/or the position on each support member of the stops or stop means can be such that the support surface is substantially flat arid level. The stop advantageously comprises a decelerating device. If, in use, a resiliently urged support member has been moved by a relatively large distance and is subjected to a relatively large returning force, and the external force is suddenly removed (for example, a person supported by the apparatus quickly moves) the decelerating device may prevent the support member from continuously accelerating towards its rest position at great speed. If a support member were allowed to return to its rest position without being decelerated and arrived at its rest position at great speed, undesirable noise could be generated and also the user might still be in a position in which they would feel the impact of the returning support member, which would of course be highly undesirable.

Conveniently the decelerating device comprises a spring. Alternatively, the decelerating means may comprise a compressible resilient material such as a foamed plastic or the like. The arrangement of the active support members may also assist in preventing a given individual support member from continuously accelerating towards its rest position, if the apparatus is so arranged that there is a maximum distance of separation between adjacent active support members. For example, if the external load on a first support member is suddenly reduced, it is likely that there will still be a substantial load supported by a second support member near to that first support member (for example, if the apparatus is used as a bed and the user of the bed rolls over, then some or all of the load supported by certain support members will effectively be transferred to other support members nearby).

The second support member would be displaced from its rest position by a distance sufficiently large enough to prevent adjacent support members and the first support member from returning to their respective rest positions by virtue of there being a maximum relative separation distance between adjacent active support members.

Whilst the apparatus may be designed so that it could be used to support a person in comfort directly on the support surface defined by the support members, the apparatus preferably further includes a flexible padded sheet arranged over the support surface. Preferably the sheet is able to be easily removed from the rest of the apparatus. The sheet may then be easily washed and a hygienic and clean surface on which the user can be supported can be maintained in a straightforward and low cost manner. Preferably, the sheet is removably fixed at a plurality of points at the periphery of the support surface. The sheet may then be relatively loosely fixed in position thereby allowing the support members to move freely beneath the sheet.

The construction of the apparatus is advantageously such that there is no requirement for the apparatus to be sealed in any substantial way. The apparatus is advantageously so configured that air is free to pass from immediately beneath the support surface, via the opposite side of the apparatus, to the exterior of the apparatus. Preferably, the apparatus is so configured that air is free to pass from the exterior of, and more preferably from underneath, the apparatus to within the apparatus and then out again via a different route. The user may therefore be cooled by the resulting movement of air which may be especially advantageous if the apparatus is in the form of a bed. Movement of air may be assisted, for example, by means of an air moving device, which can force air through the apparatus and may include air pumps, fans or the like. The temperature of the air passed through the apparatus may be controlled. For example, cool air could be passed through the apparatus to cool the user or alternatively heated air could be passed through the apparatus to warm the user. Since the apparatus, when used as bed, does not require the provision of a thick mattress the air can be passed to a region very close to the user if not directly to the user.

Preferably, the support surface is defined by an array of support members. The ends (that define the support surface) of the support members are preferably so arranged that the space between adjacent support members is relatively small or even negligible. Preferably, pairs of ends of adjacent support members are so configured that one end has a formation that engages with a formation in the other end. Advantageously, the movement of a support member is guided relative to an adjacent support member by means of their respective formations interacting with each other. The formation in a given support member advantageously comprises a recess. The area of possible contact, during normal use, between a pair of adjacent support members can thereby be reduced (in comparison to a similar pair of support members without such formations), whereby friction can be reduced. Preferably each formation is such that at least one side of the end of the support member (a side that contacts an adjacent support member) has two recesses defining a raised portion.

Furthermore, an end of one support member may have a recessed groove running in a direction parallel to the direction in which that support member may be moved and the end of the adjacent support member may have a protrusion that is accommodated by the groove. During manufacture of the apparatus the ends of the support members may thus be connected together in a row before that row is assembled in the rest of the apparatus. Manufacture of the apparatus can thereby be made easier. In use of the fully assembled apparatus the protrusion of one formation is able to move freely along the groove in which it is accommodated.

Preferably, the support surface is defined by rows of support members. The ends of the support members in each row may, in their respective rest positions, be directly adjacent to the ends of the support members in the adjacent row (the ends defining a square grid), but preferably the ends of support members in successive rows are staggered.

Each support member may comprise a rod connected to a cap, the caps being at the ends of the support members that define the support surface. Each cap may be formed integrally with its respective rod or alternatively each cap may be provided separately to the rod and subsequently fixed thereto. Each cap may be fixed to its respective rod by means of a snap-fit fixing. The caps may be formed of a different material to the rods.

The rods may be arranged in a square grid formation and the caps may be arranged in staggered rows by means of caps being positioned off centre in relation to their respective rods. Arranging the support members so that their ends form staggered rows assists in maintaining the positions of the ends of the support member in relation to each other.

The ends of the support members that define the support surface are advantageously rounded. The ends being so rounded make the support surface more comfortable especially when it conforms to the shape of the body of the user. The rounded ends need not be convex in their centres (when viewing end on), but preferably the rounded ends are such that the end face (that region visible when viewing a support member end on) is substantially entirely convex.

Advantageously guide assemblies are provided to guide the movement of the support members in a direction substantially normal to the support surface. One guide assembly may guide a plurality of support members.

Each guide assembly may guide a row of support members. Preferably each guide assembly guides two rows of support members. A guide assembly which guides two rows of support members, advantageously has a cross-section generally in the form of the letter 'T'. Each guide assembly may be formed of a light and strong material, for example, aluminium. Each guide assembly may additionally comprise a further material, such as timber, that assists in guiding the support members in a manner that avoids direct contact between the support members and the rest of the guide assembly, whereby the noise generated during use of the apparatus can be reduced. In the case where a guide assembly guides a row of a plurality of support members, the guide assembly is advantageously so configured to reduce sagging of the guide assembly during use. For example, the guide assembly may be curved so that it is slightly raised in the region where the support members in the middle of the row are guided. Alternatively the guide assembly may be prestressed so that the guide assembly, in the region where the support members in the middle of the row are guided, resists downwards movement during use.

Advantageously, the guide assembly comprises a relatively rigid bar (for example of aluminium), with for example a T-shaped cross-section, and at least one resilient bar of a relatively resilient, but stiff, material (for example timber) that has, prior to being secured to the rigid bar, a curvature along its length different from that of the rigid bar, preferably so that the middle of the resilient bar is raised above both of its ends. Thus in the assembled apparatus, the resilient bar can be secured to the rigid bar in such a way that the shape of the surface of the resilient bar against the rigid bar conforms substantially to the shape of the corresponding surface of the rigid bar, whereby the resilient bar exerts forces on the rigid bar that oppose the forces exerted on the guide assembly by a body resting on the support surface during use of the apparatus.

Conveniently, when the resiliently urged support members are urged towards an unloaded position by a respective spring, one end of the spring may act on the support member and the other end of the spring may act on the guide assembly. The end of the spring that acts on the guide assembly may be connected to the guide assembly by means of one or more coils of the spring being accommodated in a portion of the guide assembly in such a manner that axial movement of those coils towards the other end of the spring is prevented. Preferably, the spring, during construction of the apparatus, can be inserted into that portion of the guide assembly simply by translational movement in a direction substantially perpendicular to the axis of the spring.

The apparatus preferably further includes a drive device capable of moving one or more support members. Advantageously a multiplicity of the support members are drivable by a drive device. The or each drive device may be arranged to vibrate one or more support members. The support members may be so arranged to produce driven wave like motion. The support members may therefore advantageously be driven, in use, to provide a massaging effect. The apparatus may be so configured that a drive device directly drives only one support member or alternatively one drive device may directly drive several support members. The apparatus may be so configured that one or more regions of the support surface may be drivable independently of the rest of the support surface. The apparatus may be configured that substantially the entire support surface is movable by means of the drive device(s).

The apparatus is preferably so configured that it is able to support a weight of 250 Kg. Advantageously the apparatus is so configured that it is able to support completely an adult human being and preferably two adult human beings. The apparatus may be further provided with acoustic insulation, to reduce the noise produced when the support members move during use.

The present invention further provides a bed incorporating the apparatus described above with reference to the present invention. Advantageously, the bed is so configured that it does not suffer substantially from the roll together effect.

The present invention yet further provides a kit of parts including a plurality of modules, each module comprising a support surface defined by support members, each support member being mounted for movement in a direction substantially normal to the support surface, wherein at least a multiplicity of the support members are so arranged that movement of any one of those support members in a direction substantially normal to the support surface and beyond a threshold distance relative to an adjacent support member causes movement in substantially the same direction of said adjacent support member, there being substantially no movement of said adjacent support member caused by the movement of said any one of those support members when the distance of relative movement is below the threshold distance and a plurality of said multiplicity of support members are resiliently urged towards an unloaded position, the modules being so configured that they may be fixed together to form an apparatus or a bed as described above with reference to the present invention. Accordingly the apparatus/bed may be manufactured in modules, which may then be sold to the consumer, the consumer being able easily to transport and assemble the apparatus/bed for use. Preferably, the modules are so configured that the apparatus/bed is formed by fixing the modules together in a single row. The width of the assembled apparatus/bed thus depends on the width of the modules whereas the length of the assembled apparatus/bed can be adjusted by adding or removing modules. The manufacturer of the modules need only make modules in a small number of standard widths, so that the consumer can purchase a number of modules, each of a width corresponding to the desired width of the apparatus/bed, the number of modules being chosen by the consumer according to the desired length of the assembled aparatus/bed.

Figure 3:
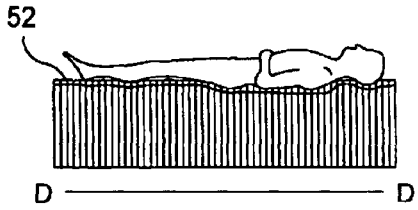
Figure 2:
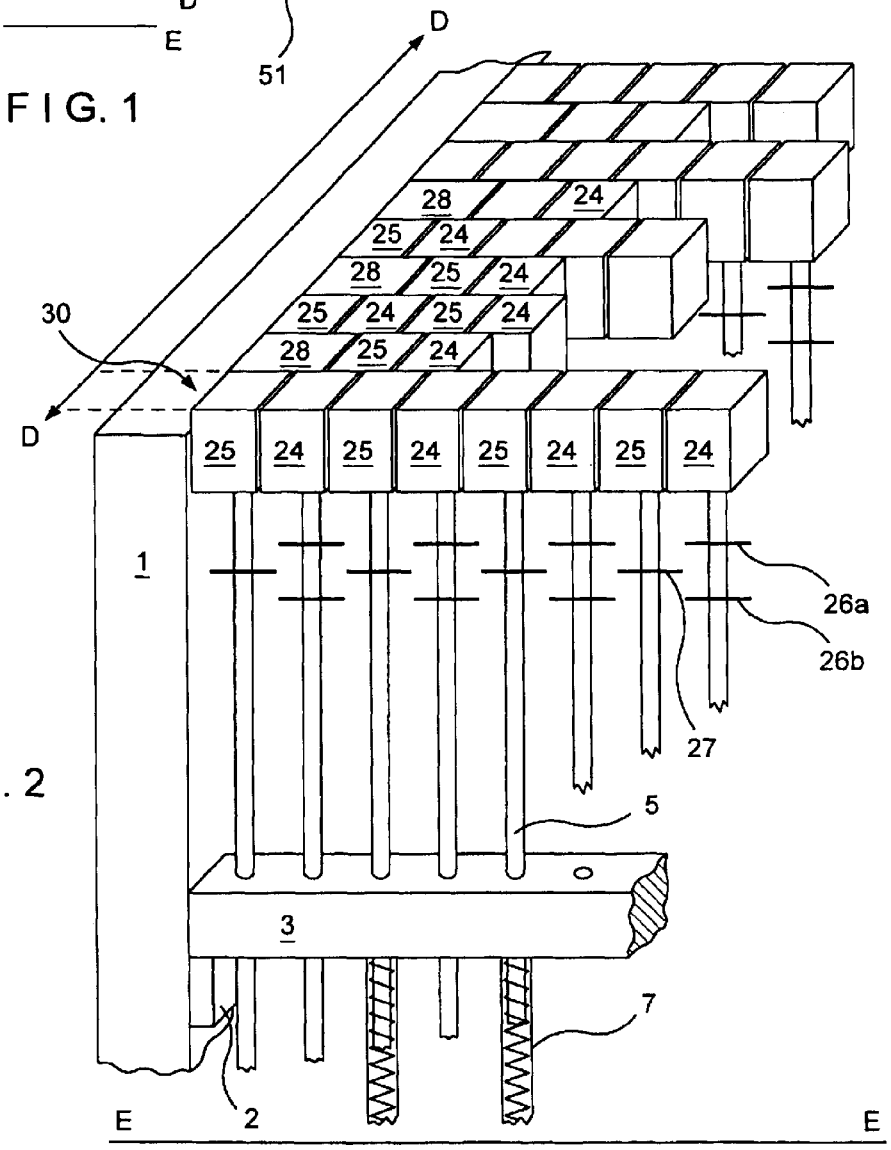
Figure 4:
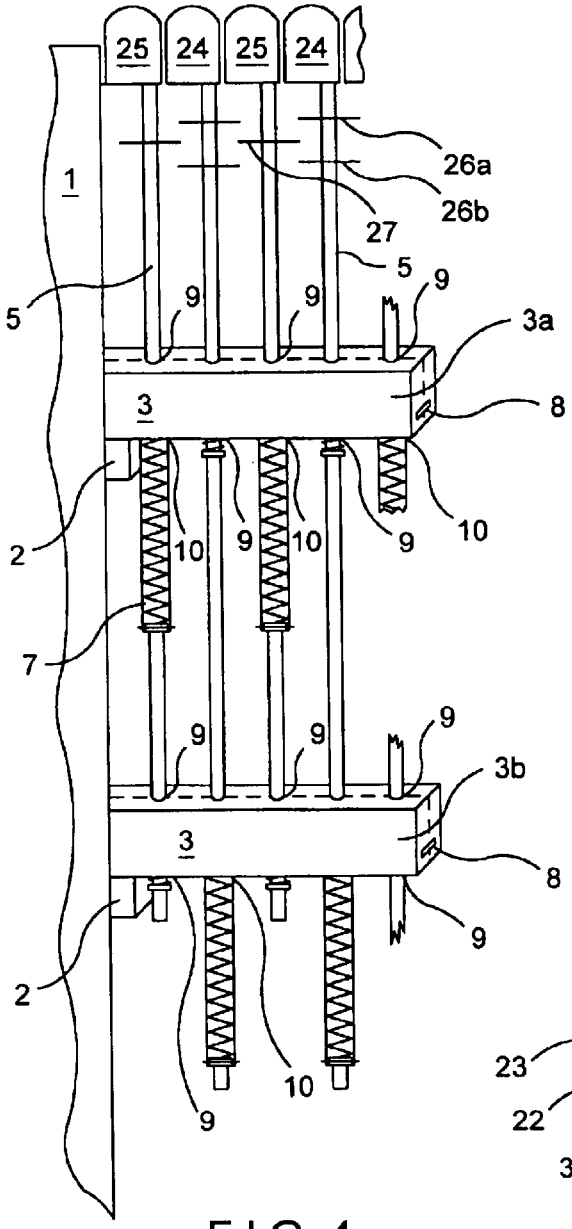
Figure 9A:
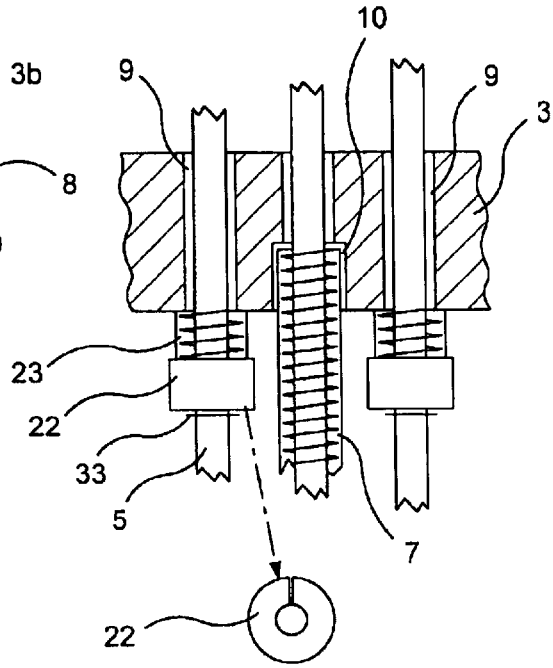
Figure 5:
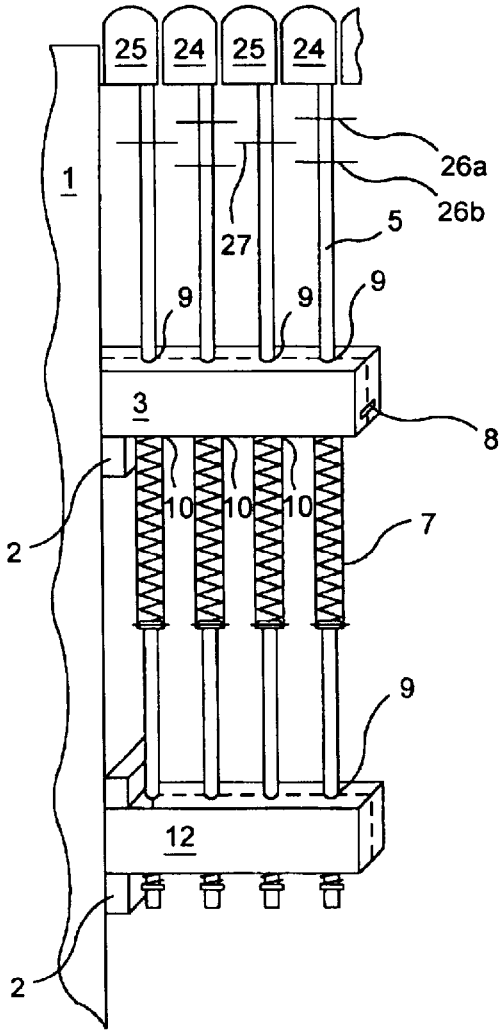
Figure 6:
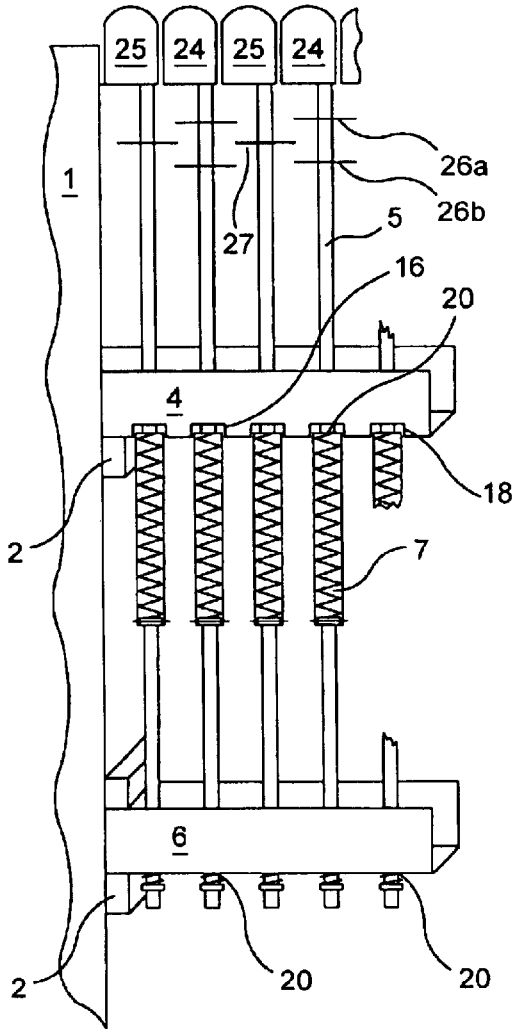
Figure 6B:
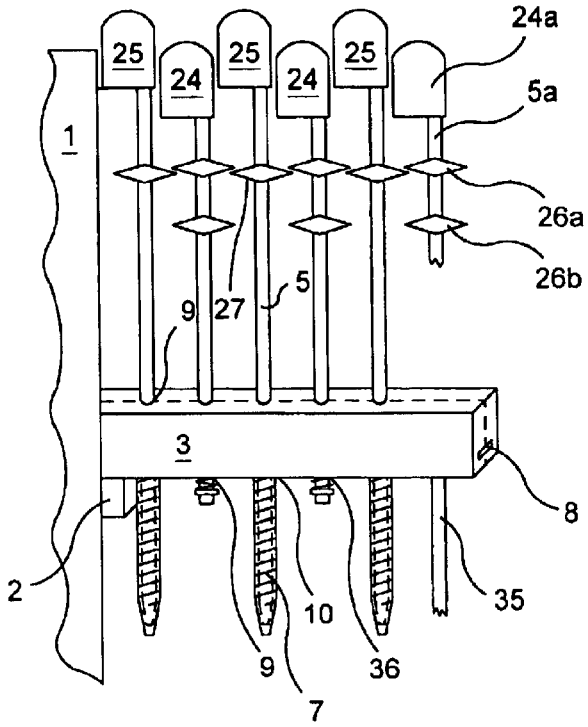
Figure 8B:
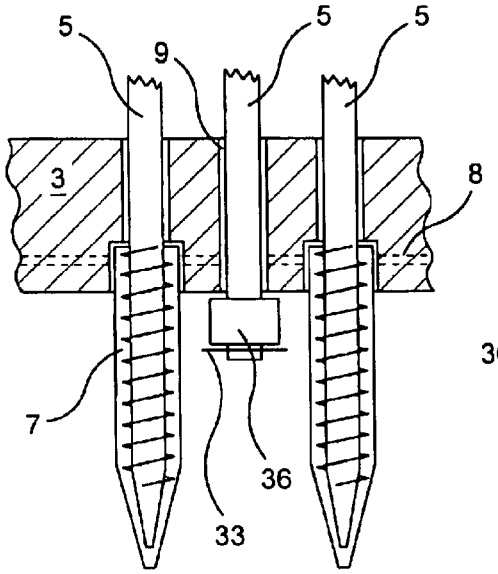
Figure 9B:
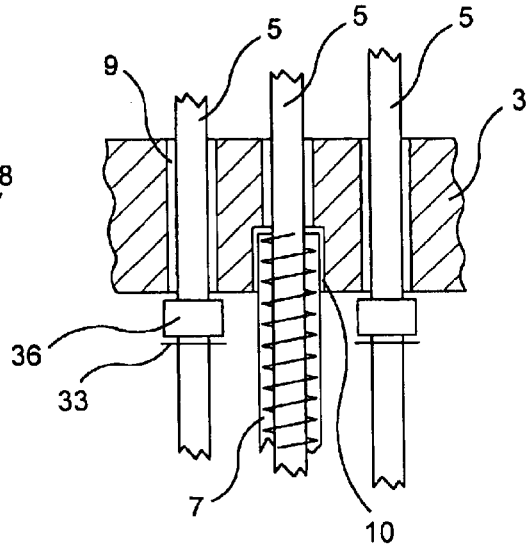
Figure 7:
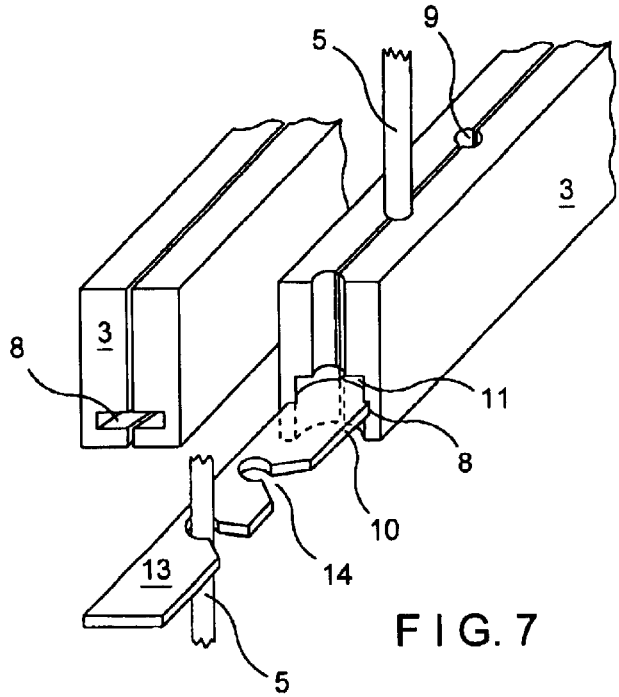
Figure 18:
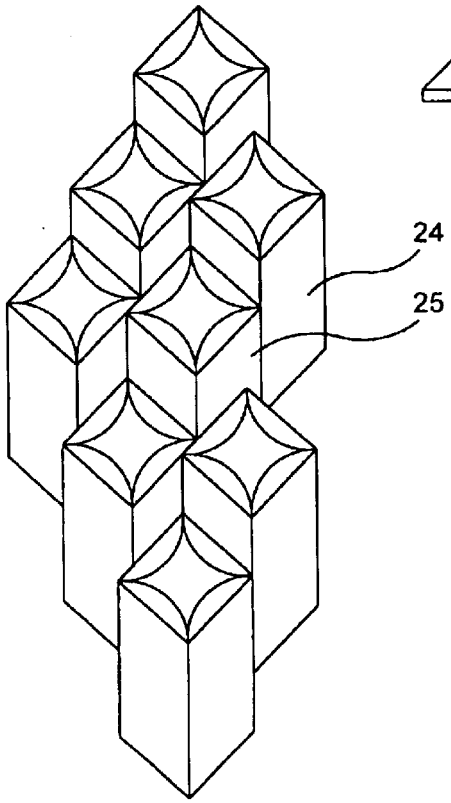
Figure 8A:
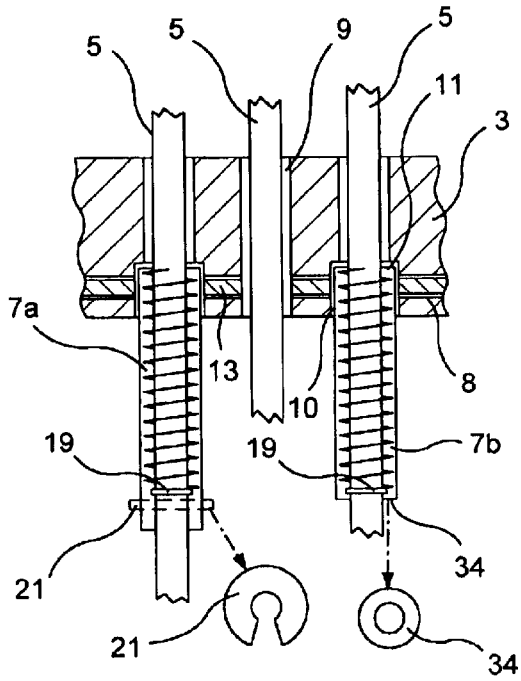
Figure 10:
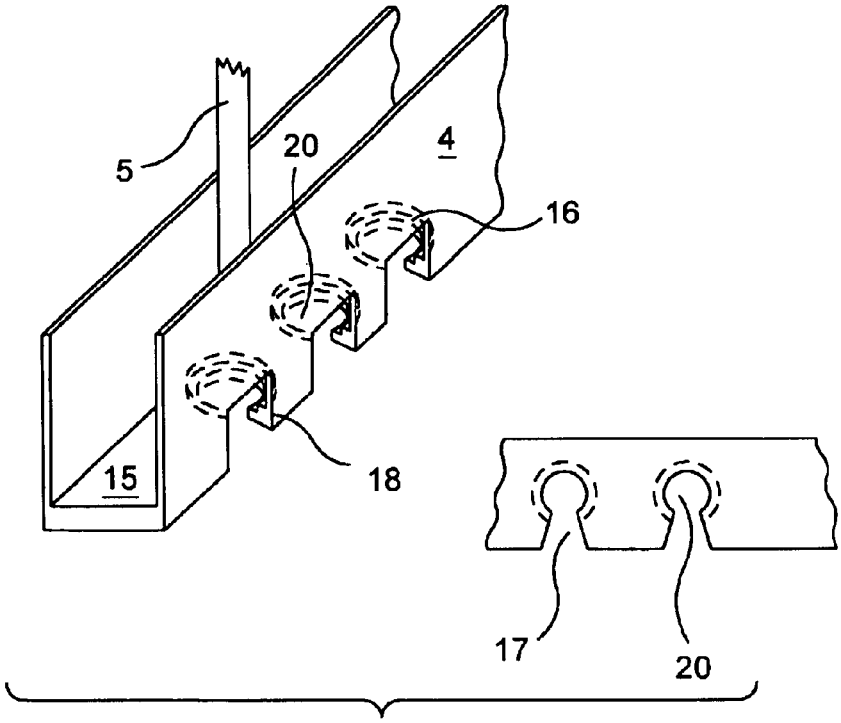
Figure 11:
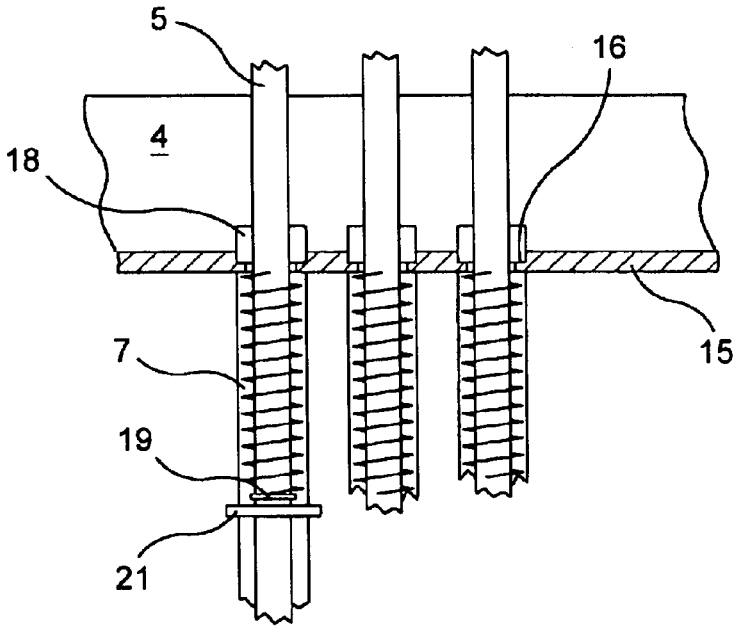
Figure 12:
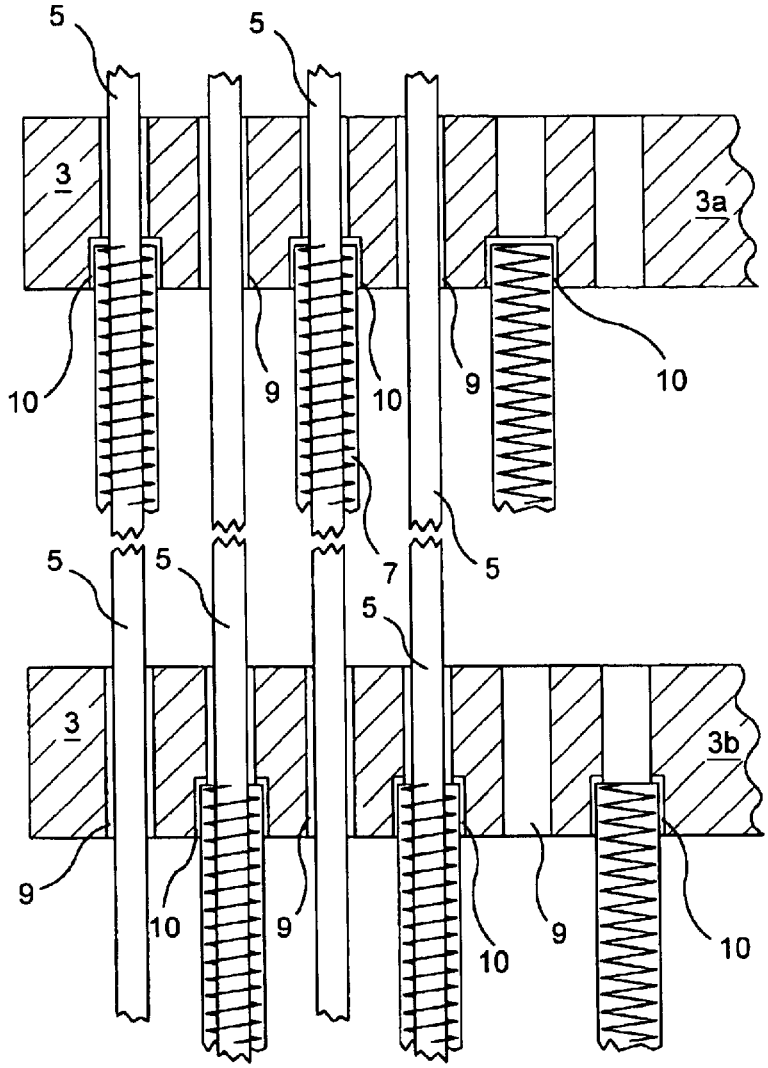
Figure 19:
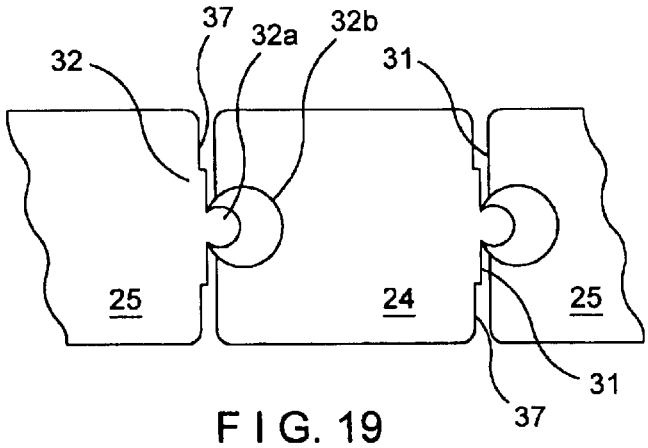
Figure 13:
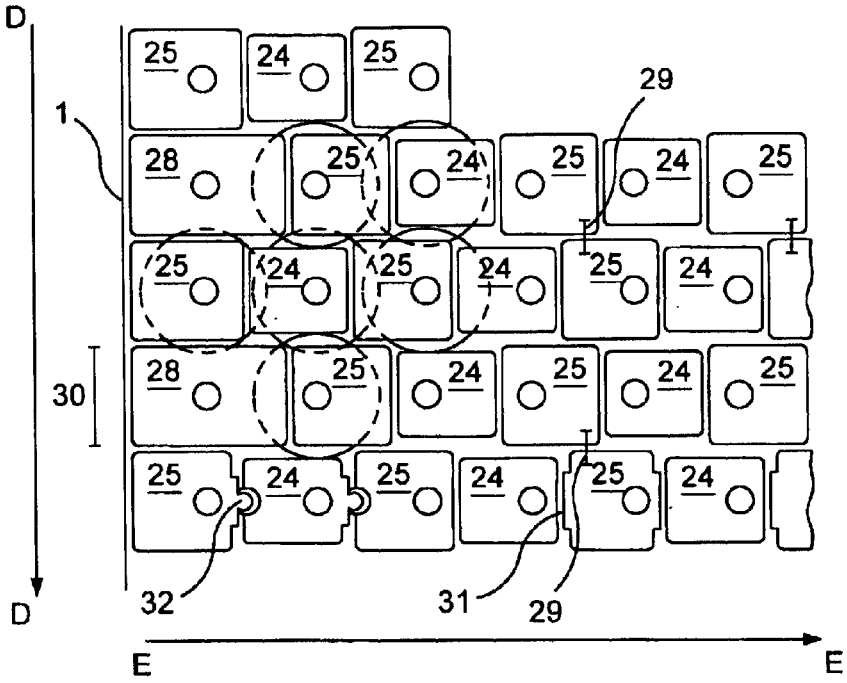
Figure 15:
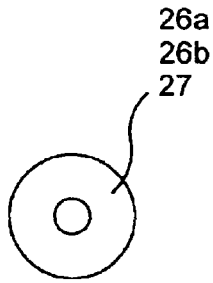
Figure 14:
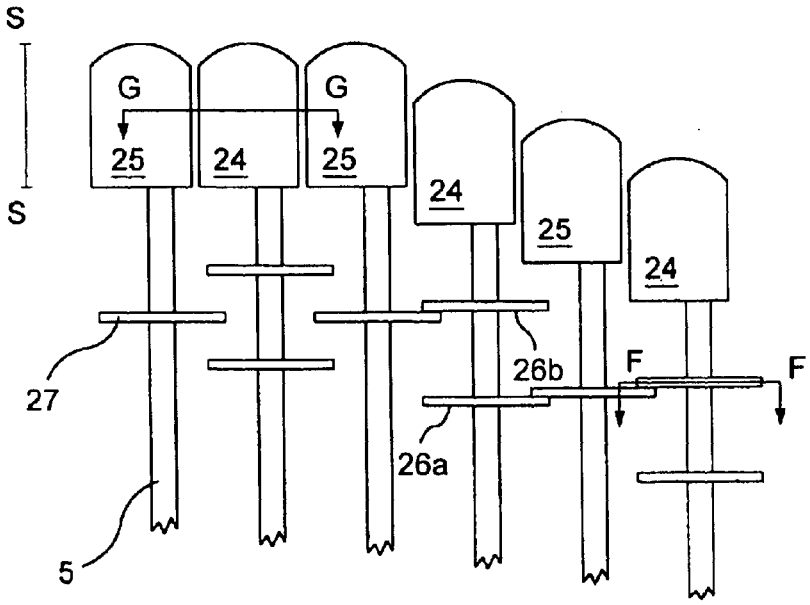
Figure 16:
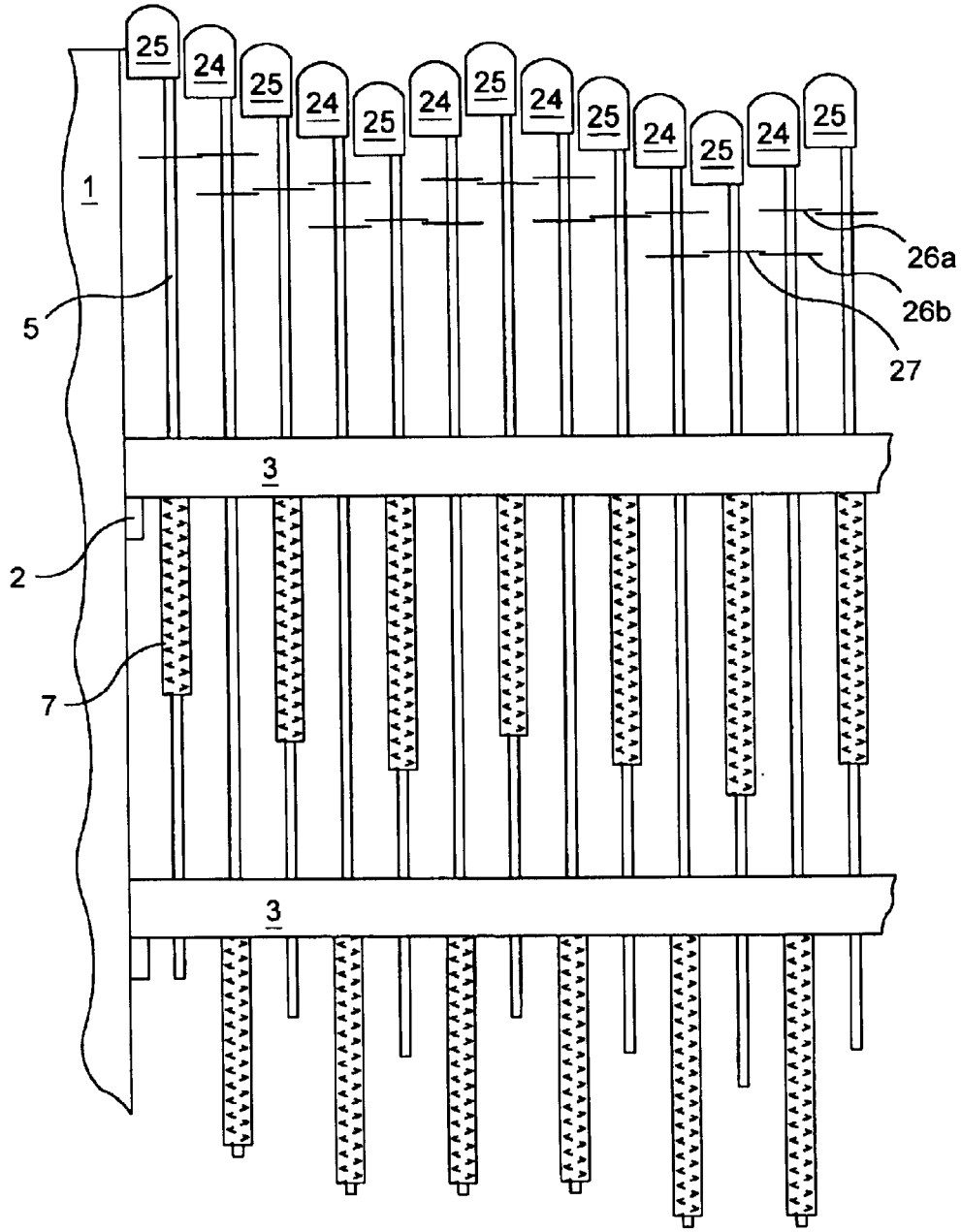
Figure 17:
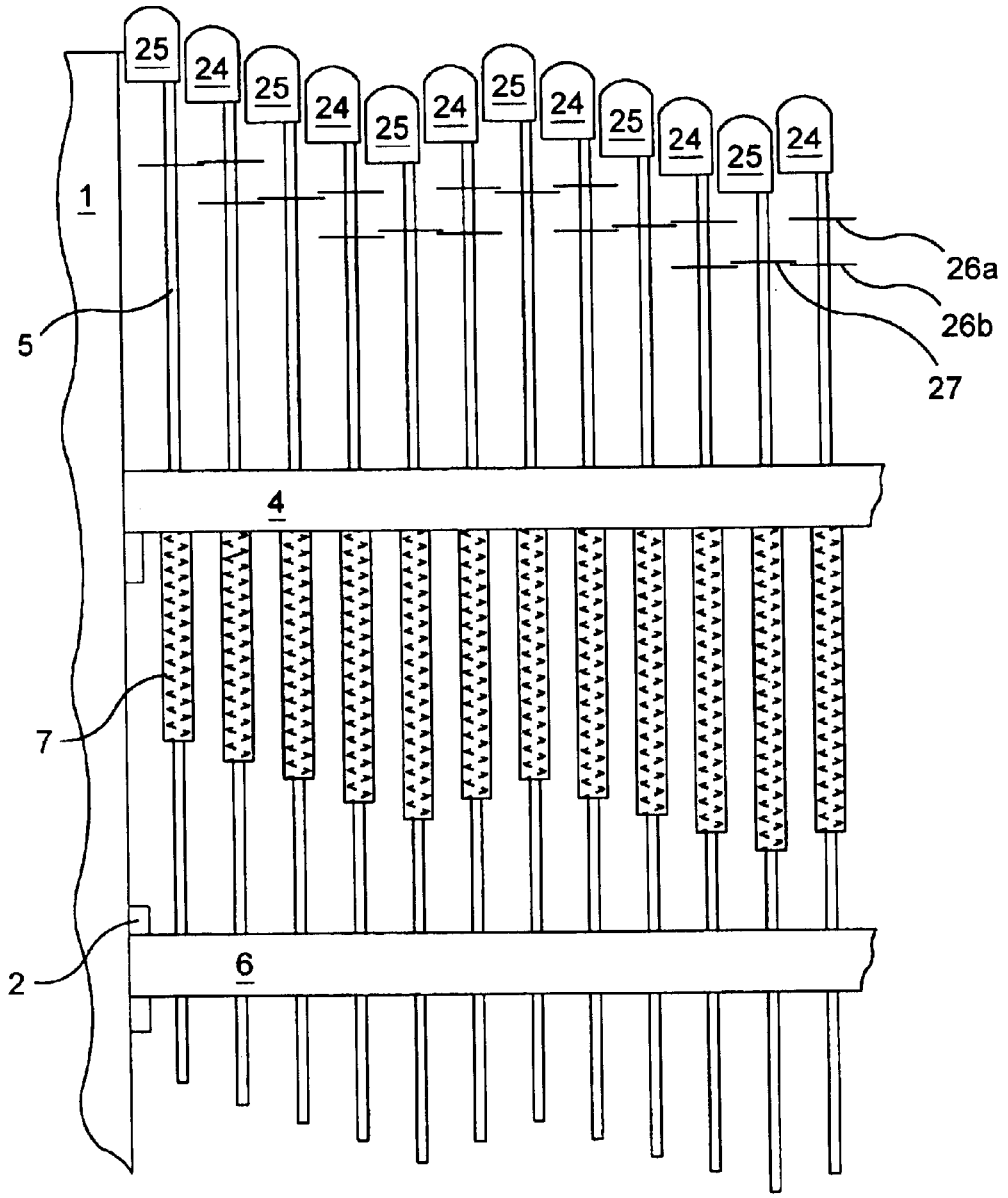
Figure 20:
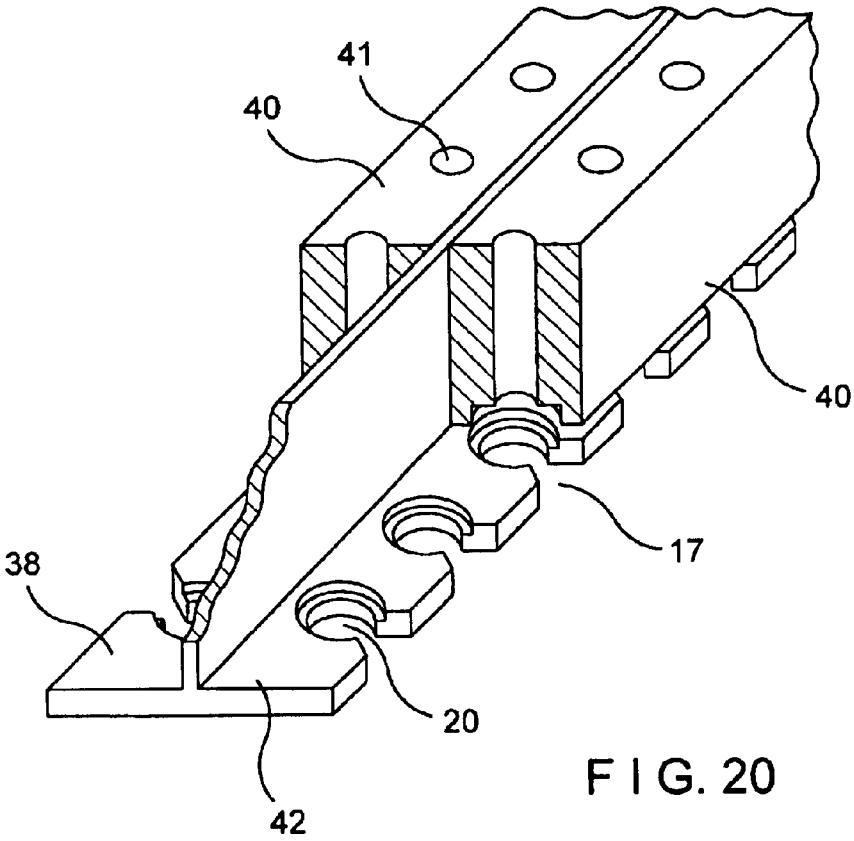
Figure 21:
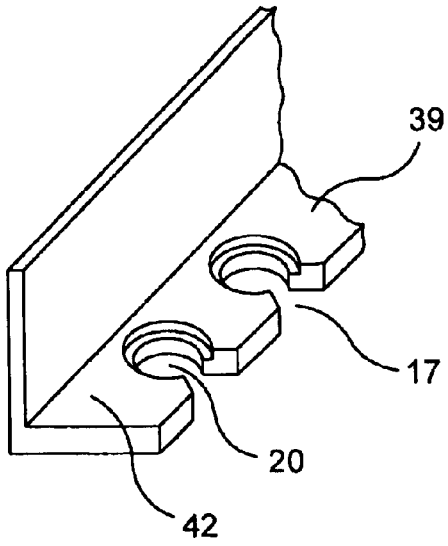

By way of example embodiments of the invention will now be described with reference to the accompanying schematic drawings, of which:

FIG. 1 is a perspective view of a bed including a multiplicity of support members defining a support surface, FIG. 2 is a perspective view of a section of a bed of FIG. 1, FIG. 3 is a side view of the bed of FIG. 1 in use, FIG. 4 is a section of the bed of FIG. 1 shown partly in perspective and partly in cross-section showing the arrangement of support members of the bed of FIG. 1, FIG. 5 shows an alternative arrangement of the support members to that shown in FIG. 4, FIG. 6A shows a further alternative arrangement of the support members to that shown in FIG. 4, FIG. 6B shows yet a further alternative arrangement of the support members to that shown in FIG. 4, FIG. 7 shows sections of two support bars, one in perspective and the other partially cut away and in perspective, through which support members of the bed of FIG. 1 pass, FIG. 8A shows a cross-section of one of the support bars shown in FIG. 7 and the support members passing therethrough, FIG. 8B shows an alternative arrangement to that shown in FIG. 8A, FIG. 9A shows a cross-section of portions of the support members of the bed in FIG. 1 in the region of the upper support bar (as seen in FIG. 4), FIG. 9B shows an alternative arrangement of the support members to that shown in FIG. 9A, FIG. 10 shows an alternative arrangement to that shown in FIG. 7 incorporating the arrangement shown in FIG. 6A, FIG. 11 shows a cross-section of one of the support bars shown in FIG. 10 and the support members passing therethrough, FIG. 12 is a cross-sectional view of a part of the bed of FIG. 1 showing two support bars and the support members passing therethrough, FIG. 13 is a plan view of the support members of the bed of FIG. 1, FIG. 14 shows a cross-section of support members of the bed of FIG. 1, when in use, FIG. 15 is a cross-section (along the lines of F—F of FIG. 14) of a support member, FIG. 16 shows a cross-section of the bed of FIG. 1 in use, FIG. 17 shows a cross-section of a bed, in use, incorporating the arrangement shown in FIG. 10, FIG. 18 is a perspective view from above of the support members of the bed of FIG. 1 in use, FIG. 19 shows a cross-section (taken along the lines G—G of FIG. 14) of three support members, FIG. 20 is a perspective view of part of a support bar in an alternative arrangement to that shown in FIG. 7, and FIG. 21 is a perspective view of part of a support bar in a further alternative arrangement to that shown in FIG. 7.

FIG. 1 shows a bed according to a first embodiment of the present invention. The bed comprises a rigid support frame 1 of solid timber or man made timber board. Acoustic insulation material (not shown) is provided within the base and side of the frame 1. The frame is provided with four feet (not shown) at each corner. The height of the feet is adjustable so that the bed may be arranged securely on an uneven surface. The top edges of the frame 1 are padded for comfort. A drive device 50 and an air moving device 51 are also shown.

As can be seen from FIG. 2, the upper surface of the bed is defined by a multiplicity of support members, each support member comprising a rod 5 and a cap 24, 25, 28. As shown in FIG. 4, each cap 24, 25, 28 has a rounded upper surface. A padded sheet 52 is provided to improve comfort. The padded sheet 52 is attached over the support surface and is removably fixed at fixing points on the frame 1 so that the sheet is loosely fixed in place. The sheet 52 may then be removed for washing.

The bed includes two rows of support bars 3 (see FIG. 4), one row arranged above and spaced apart from the other. A rod 5 of each support member passes through an upper support bar 3*a* and a lower support bar 3*b*. Each support bar 3 extends from one side of the bed to the other and accommodates a plurality of support members. The support bars are mounted on support battens 2 fixed to frame 1.

Each support bar 3 is made from two lengths of timber that form two halves of the bar 3 (see the broken line shown on the bars 3 in FIG. 4). Each bar 3 has a passageway 8 of rectangular cross-section that runs along its length and near to its base. The rods 5 of the support members pass through passageways 9 formed in the support bars 3.

With reference to FIG. 4 each rod 5 is provided with a tension spring connected to one of the two support bars 3*a*, 3*b* through which the rod 5 passes. Thus as shown in FIG.

4 every other rod is provided with a spring 7 connected to the upper support bar 3*a*, those rods not being provided with a spring connected to the upper bar being provided with a spring 7 connected to the lower support bar 3*b*. The tension springs 7 are attached at their lower ends to the rods 5 and the upper end of each spring is accommodated within a respective passageway 10 formed in the support bar 3. FIG. 12 shows a cross-sectional view illustrating how the two support bars 3, rods 5 and springs 7 are arranged in relation to each other in the assembled bed.

FIG. 7 illustrates how each spring 7 is accommodated and held within the support bar 3. As can be seen from FIG. 7, passageway 10 is of a larger diameter than passageway 9, is formed co-axially with passageway 9 and extends from beneath the support bar 3 upwards and beyond rectangular passageway 8. The diameter of passageway 10 is slightly smaller than the width of passageway 8. The region of the passageway 10 above the rectangular passageway 8 will hereinafter be referred to as the void 11. Each spring 7 is held in place by means of a support strip 13 formed with keyholes 14 through which the rods 5 pass. The top few coils of each spring 7 are accommodated within the void 11, the tops of the springs thereby effectively being fixed within the void 11 in the assembled bed.

The rods 5, support bar 3, support strip 13, and springs 7 are assembled as follows. The support bar 3 is provided in two halves and the support strip 13 is placed in the groove that forms half of the passageway 8. The support strip 13 is made from flexible plastic and is about the same length as the support bar 3 and is slightly smaller in cross-section than the rectangular passageway 8 (within which it is accommodated in the assembled bed). The support strip 13 is moved so that the keyholes 14 are aligned with the formations that form the passageways 9, 10 in the assembled support bar 3. A tension spring 7 and a rod 5, the rod passing through the spring 7, are together pushed into the keyhole 14 of the support strip 13 so that three or four of the coils of the spring 7 are accommodated within the void 11 and above the support strip 13. The neck of the keyhole 14 may be slightly narrower than the rod 5 so that the rod 5 snaps into place. The other end of the spring 7 is secured to the rod 5 as will be described later. Once all the rods 5 and springs 7 are in place in the one half of the support bar 3, the other half is placed over the first half and both halves are secured.

FIG. 8A shows two ways in which the lower end of each spring may be connected to its respective rod 5. With reference to the spring 7*a* on the rod on the left of FIG. 8A, a spring clip hold 19 is secured to the rod 5 (or the rod may alternatively be formed with a spring clip hold integrally). The spring 7*a* is pulled down and over the spring clip hold 19 and a spring clip 21 (a cross-section of which also being shown in FIG. 8A) is then pushed between two coils of the spring below the spring clip hold and around the rod 5, thereby holding the spring 7*a* at this position under the spring clip hold 19. Alternatively, and with reference to the spring 7*b* on the rod 5 on the right of FIG. 8A the spring 7*b* may be closed at its lower end 34 (a cross-section of which also being shown in FIG. 8A), so that the spring itself abuts directly against the spring hold 19.

Each rod 5 is provided with a stop attachment 22 (see FIGS. 4 and 9A). Every other rod 5 in a row has a stop attachment 22 directly beneath the upper support bar 3*a*, the other rods 5 in the row having their stop attachments 22 provided directly beneath the lower support bar 3*b*. Each rod 5 therefore is provided with a spring 7 connected to one support bar 3 and a stop attachment 22 provided beneath the other support bar 3. Between each stop attachment 22 and the support bar 3 is provided a compression spring 23. The stop attachment 22 and spring 23 are held in place by means of a stop hold 33 fixed in position on the rod 5. The compression springs 23 and rod stop attachments 22 are so arranged that the tension springs 7 are extended under slight tension when the rods are in their rest positions (when no external load is applied). The compression spring 23 acts, in use, as a break/cushion.

With reference to FIGS. 13 and 14 every other rod 5 in a row 30 of rods is provided with a single pusher 27, the other rods in the row being provided with two pushers 26*a*, 26*b*. Each pusher is fixed to the rod 5 (or alternatively, may be moulded as an integral part thereof). When all of the rods 5 are in their rest positions (when no external loads are applied) the single pushers 27 lie on a notional plane positioned midway between the two notional planes on which the pairs of two pushers 26*a* and 26*b* lie. The pushers are each formed of a thin, but rigid disc (see the section shown in FIG. 15) of plastic. Adjacent pushers contact each other when adjacent rods 5 are moved relative to one another by more than a fixed threshold distance. The threshold distance in respect of each pair of support members is preferably less than half the distance between the centres of support members. Preferably the threshold distance is less than 10 mm, and preferably greater than 5 mm. The threshold distance in respect of the first embodiment is about 8 mm.

With reference to FIG. 13, whilst a pusher on a rod is able to engage directly with pushers on rods immediately to the right or left or immediately above or below the rod, pushers on diagonally adjacent rods are not able to push each other directly. Thus, if a single rod 5 is moved downwards by just more than the threshold distance, the four rods directly adjacent to that single rod are pushed in the same direction by means of a pusher on that single rod in the centre contacting and pushing the pushers below on the adjacent rods (the rods diagonally next to the centre rod would not be moved directly by the centre rod). FIG. 16 shows how the pushers of adjacent rods 5 engage when the support surface is subjected to a load.

Each pair of caps 24, 25, 28 in a row of caps are linked by means of a ball and groove joint 32 (as is shown partly in FIG. 13 and more clearly in FIG. 19). With reference to FIG. 19, the ball and groove joint 32 comprises a generally ball-shaped protrusion 32*a* on one cap 25 accommodated by a generally cylindrical groove 32*b* on the other cap 24. The diameter of the ball 32*a* is slightly greater than the width of the neck of the groove 32*b* and the ball shaped protrusion 32*a* can therefore be pushed into the groove 32*b* as a snap fit. (The shape of the protrusion accommodated by the groove need not be ball-shaped, of course, and could instead be substantially cylinderical.)

Each cap may also be rebated on each of the two sides 31 that face adjacent caps in the row 30 (see, for example, the recesses 37 shown in FIG. 19) to minimise the surfaces of contact between adjacent caps, thereby reducing friction. The caps in adjacent rows 30 are generally separated from each other by a small gap, but the square caps 25 in successive rows may touch where their opposing surfaces overlap (see the region labelled 29 in FIG. 13 for example).

As can be seen from FIG. 13 the caps 24, 25, 28 are arranged in rows 30, successive rows being staggered (the caps, when viewed from above, forming a pattern similar to that of a brick wall). The arrangement of the rods 5 however is such that the centres of the rods 5 when viewed from above, form a square grid (see FIG. 13). The staggering of the rows 30 of the caps is achieved by caps 24, 25 being mounted off centre on the rods 5. Staggering the rows 30 of the caps (for example, in the way illustrated by FIG. 13), assists in maintaining the structure of the support surface and in reducing friction between adjacent caps. As can be seen from FIG. 13, every other row starts (from the left) with a elongated cap 28 mounted centrally on a rod 5, the other rows starting with a cap 25 with a rod extending from the right (when viewed from above as shown in FIG. 13) of the centre of the cap 25. In 3 row starting (from the left as shown in FIG. 13) with an elongated cap 28, the rest of the caps are such that the rods are positioned to the left of the respective centres of the caps. The rows that do not start with an elongated cap 28 end (to the right of and not shown in FIG. 13) with an elongated cap mounted centrally on its rod, those rows having caps (apart from the last in the row) with their rod positions to the right of the respective centres of the caps (as viewed in FIG. 13). With reference to FIG. 13 successive caps in a row alternate between approximately square shaped caps 25 (in cross-section) and caps 24 having the same width (along the line E—E) as those square caps 25 but being slightly shorter (along the line D—D). For example, the slightly shorter caps 24 may be 20 mm wide (along the line E—E) and 18 mm deep (along the line D—D), the square caps 25 may be 20 mm wide and 20 mm deep and the elongate caps 28 may be 28 mm wide (along the line E—E) and 20 mm deep (along the line D—D). The caps at the beginning of each row (and also the column of caps at the ends of the rows) are in close contact with each other (see FIG. 13) which aids the maintenance of the arrangement of the caps in relation to each other during use. With reference to FIG. 14, the caps are each 30 mm tall (along the line S—S). With reference to FIG. 1, the bed is about 2 meters long (in the direction D—D) and about 1 meter wide (in the direction E—E), there being 104 rows 30 of 46 caps, and there therefore being a total of over 1000 caps.

When a person lies on the bed the support surface, defined by the caps connected to the rods, supports and contours the body by moving in accordance with the weight, the shape and the movement of the body lying on the bed (see FIG. 3).

As will be appreciated, modifications may be made to the above-described embodiment of the invention, some of which are described below.

According to a second embodiment of the invention (illustrated by FIG. 5), rather than providing two support bars, each carrying tension springs and being associated with stop attachments, one support bar could carry all the necessary tension springs and the other support bar could be associated with all of the necessary stop attachments. The lower support bar 12 need not be provided with a rectangular longitudinal aperture as that support bar 12 does not need to accommodate any springs and therefore construction of that lower support bar 12 may be simplified. Furthermore, the lower support bar need not be formed in two parts and then connected (contrary to the illustration of FIG. 5) and can instead be formed as a one piece member. The lower support bar 12 may even be omitted completely. The rods 5 need then not be provided with stops and can accordingly be made much shorter.

A third embodiment of the present invention is illustrated by FIGS. 6A, 10, 11 and 17. As can be seen from FIG. 6A, the support bars are formed from U-shaped aluminium channels. The upper support bar 4 is provided with holes 20 through which the rods pass and larger holes 16 that facilitate connection of the tension springs 7. The method of connecting the tension springs 7 to the upper support bar 4 of FIG. 6A is illustrated in more detail in FIGS. 10 and 11. The floor 15 of the support bar 4 is formed with larger holes 16 formed co-axially with holes 20 and extending only part of the way into the floor 15 thereby forming a step around each hole 20. The support bar 4 is further provided with rectangular apertures 18 in one side wall. The apertures 18 lead into keyholes 17 formed in the floor 15 of the upper bar 4, the hole of each keyhole being formed by a hole 20 which may accommodate a rod. Each tension spring 7 and rod 5 is assembled in the support bar 4 by pushing the spring 7 through a rectangular aperture 18 so that at least one coil of the top of the spring is accommodated within the step that defines the large hole 16. The rod 5 is then inserted through the spring 7 and into and through the hole 20. The neck of the keyhole 17 is slightly smaller than the diameter of the rod 5. The other ends of the springs 7 may then be secured to the rods by means of a spring clip hold 19 and spring clip 21 in a manner similar to that described with reference to FIG. 8A. FIG. 17 illustrates how this alternative arrangement is configured and shows a bed in use the rods 5 having been moved from their rest positions by means of an external load. The lower support bar 6 need only be provided with stop attachments 20 (see FIG. 6A) and therefore the lower support bar 6 can be formed simply of a U-shaped channel with holes 20 formed in its floor to allow the rods to pass therethrough.

FIGS. 6B, 8B and 9B show a fourth embodiment of the invention illustrating further modifications that could be made to the above-described embodiments of the invention. The bed is shown in FIG. 6B with the rods 5 in their rest positions. The caps 24, 25 do not form a flat support surface when in the rest position since some of the caps 24 lie on a notional plane lower than the notional plane on which the other caps 25 lie (but of course, the rods and caps may be so configured that the surface is flat when the rods are in their rest position).

The support members alternate along each row between a support member being provided with a tension spring 7 and provided with one pusher 27 and a support member that is not sprung but is provided with a stop 33, 36 and two pushers 26*a*, 26*b*. There is only one support bar 3 through which the rods 5 of the support members pass. The support bar 3 is constructed in a similar manner to that described with reference to the first embodiment illustrated by FIG. 4.

The tension springs 7 are connected to the rods 5 by means of both the rod and spring being tapered at their lower ends (see FIG. 8B). The spring 7 cannot therefore be pulled over the rod (under conditions of normal use) and therefore the rod 5 is held within the spring 7.

The stop provided on the unsprung rods 5 comprise a soft foam washer 36 (see FIG. 9B) that is held in position by means of a stop hold 33 (a clip that may be secured to the rod 5 in a conventional manner—for example, the rod 5 may be formed with a groove that holds the clip in place).

Each support bar 3 of the fourth embodiment is provided with a support leg 35 between the two sides of the bed to provide extra structural support for the support bars 3. The support leg 35 is provided with an adjustable foot (not shown). The rod 5*a* directly above the support leg 35 does not pass through the support bar 3 and is much shorter than the rods 5 of the other support members. That central support member (comprising the short rod 5*a* and cap 24*a*) is held in position by means of the surrounding caps.

The pushers are provided with inclined edges as can be seen in FIG. 6B which ease assembly of the bed. The pushers may of course have any suitable cross-section (when viewed from above). The pushers may be any shape that facilitates the direct pushing of pushers adjacent to but not diagonally adjacent to the pusher. For example, the pushers may be generally circular, octagonal or cruciform in shape.

Whilst the ends of the caps 24, 25 may simply be rounded, they may have a portion on their upper surface that is substantially flat (see FIG. 18 for example).

FIG. 20 illustrates part of a support bar assembly of a fifth embodiment of the present invention. The support bar assembly comprises an aluminium bar 38 (shown partly cut-away for the sake of clarity) having an inverted T-shaped cross-section and two timber bars 40 (shown partly cut-away for the sake of clarity). The support bar assembly 38, 40 supports and guides two rows of support members (not shown) which pass through cylindrical passageways 41 in the timber bars 40 and holes 20 in the aluminium bar 38. The cylindrical passageways 41 have a diameter slightly smaller than that of the holes 20 in the aluminium bar 38, so that the rods 5 (not shown) of the support members are guided by the timber bars and generally do not, during normal use, contact the sides of the aluminium bar 38 that define the holes 20. Noise generated during use of the apparatus is thereby reduced. Prior to assembling the support bar assembly, the upper surface 42 of the aluminium bar 38 is generally flat and the underside of each of the timber bars 40 is curved in shape (for example, so that the middle of the bar is 10 mm higher than its ends). When the curved timber bars 40 are fixed to the flat surface 42 of the aluminium bar 38 the timber bars 40 are straightened, but owing to their natural resilience are under stress (by virtue of the forces urging each bar to adopt its previously curved shape). The aluminium bar 38 is therefore subjected to forces that oppose sagging of the bar 38 under the weight of the support members and any bodies resting thereon during use of the apparatus. The construction of the apparatus of the fifth embodiment may otherwise be similar to that of the third embodiment. For example, the springs (not shown in FIG. 20) may be attached to the rods (not shown) and the aluminium bar 38 in much the same way as that described with reference to FIG. 11.

FIG. 21 shows part of a support bar assembly that differs from that shown in FIG. 20 in that the aluminium bar 39 of the support bar assembly is generally L-shaped in cross-section and the support bar assembly is configured to support and guide only one row of support members (not shown). Only one timber bar (not shown) is associated with each aluminium bar 39.

Whilst the embodiments described above relate to beds for supporting a human being, the present invention also has application in supporting other bodies such as animals, or even inanimate objects, having a mass greater than 1 Kg.

It will be appreciated that at least some of the features described in relation to a given embodiment or aspect of the invention can be incorporated into a different embodiment or aspect of the invention. For example, the support bar assembly including a T-shaped bar of the fifth embodiment may be incorporated into the apparatus described with reference to the fourth embodiment (with or without the provision of support legs for the support bars).

What is claimed is:

1. Body support apparatus comprising a support surface defined by support members, each support member being mounted for movement in a direction substantially normal to the support surface, wherein at least a multiplicity of the support members are each provided with a pusher, said multiplicity of support members being so arranged that movement of a first support member having a pusher in a direction substantially normal to the support surface and beyond a threshold distance relative to a second support member, the second support member being adjacent to said first support member, causes said pusher of said first support member to push said adjacent support member in substantially the same direction as said first support member, there being substantially no movement of said second support member caused by the movement of said first support member when the distance of relative movement is below the threshold distance, and a plurality of said multiplicity of support members are resiliently urged towards an unloaded position.

2. Apparatus according to claim 1, wherein the pusher is in the form of a thin rigid disc.

3. A bed comprising support members, each support member comprising a rod connected to a cap, the caps being at the ends of the support members and defining a support surface, each support member being mounted for movement in a direction substantially normal to the support surface, wherein at least a multiplicity of the support members are each provided with a pusher, said multiplicity of support members being so arranged that movement of a first support member having a pusher in a direction substantially normal to the support surface and beyond a threshold distance relative to a second support member, the second support member being adjacent to said first support member, causes said pusher of said first support member to push said adjacent support member in substantially the same direction as said first support member, there being substantially no movement of said second support member caused by the movement of said first support member when the distance of relative movement is below the threshold distance, and a plurality of said multiplicity of support members are directly resiliently urged towards an unloaded position by means of a respective tension spring under tension, whereby movement of a support member associated with a tension spring in a direction away from the support surface causes the tension in the tension spring to increase.

4. Body support apparatus comprising a support surface defined by support members, each support member being mounted for movement in a direction substantially normal to the support surface, wherein at least a multiplicity of the support members are so arranged that movement of any one of those support members in a direction substantially normal to the support surface and beyond a threshold distance relative to an adjacent support member causes movement in substantially the same direction of said adjacent support member, there being substantially no movement of said adjacent support member caused by the movement of said any one of those support members when the distance of relative movement is below the threshold distance and a plurality of said multiplicity of support members are directly resiliently urged towards an unloaded position in such a way that the return force increases continuously with the distance of the support member from the unloaded position up to a distance at which the return force is a maximum, wherein the apparatus is so arranged that an angle of inclination of the support surface relative to the support surface when unloaded is limited to a maximum angle of between 10 and 30 degrees.

5. Body support apparatus comprising a support surface defined by support members, each support member being mounted for movement in a direction substantially normal to the support surface, wherein at least a multiplicity of the support members are so arranged that movement of any one of those support members in a direction substantially normal to the support surface and beyond a threshold distance relative to an adjacent support member causes movement in substantially the same direction of said adjacent support member, there being substantially no movement of said adjacent support member caused by the movement of said any one of those support members when the distance of relative movement is below the threshold distance and a plurality of said multiplicity of support members are directly resiliently urged towards an unloaded position in such a way that the return force increases continuously with the distance of the support member from the unloaded position up to a distance at which the return force is a maximum, wherein less than two thirds of said multiplicity of support members are directly resiliently urged towards an unloaded position.

6. Body support apparatus comprising a support surface defined by support members, each support member being mounted for movement in a direction substantially normal to the support surface, wherein at least a multiplicity of the support members are so arranged that movement of any one of those support members in a direction substantially normal to the support surface and beyond a threshold distance relative to an adjacent support member causes movement in substantially the same direction of said adjacent support member, there being substantially no movement of said adjacent support member caused by the movement of said any one of those support members when the distance of relative movement is below the threshold distance and a plurality of said multiplicity of support members are directly resiliently urged towards an unloaded position in such a way that the return force increases continuously with the distance of the support member from the unloaded position up to a distance at which the return force is a maximum, wherein each of the resiliently urged support members is associated with a respective stop.

7. Apparatus according to claim 6, wherein the stop comprises a decelerating device.

8. Body support apparatus comprising a support surface defined by support members, each support member being mounted for movement in a direction substantially normal to the support surface, wherein at least a multiplicity of the support members are so arranged that movement of any one of those support members in a direction substantially normal to the support surface and beyond a threshold distance relative to an adjacent support member causes movement in substantially the same direction of said adjacent support member, there being substantially no movement of said adjacent support member caused by the movement of said any one of those support members when the distance of relative movement is below the threshold distance and a plurality of said multiplicity of support members are directly resiliently urged towards an unloaded position in such a way that the return force increases continuously with the distance of the support member from the unloaded position up to a distance at which the return force is a maximum, wherein the ends of a multiplicity of the support members are arranged in staggered rows.

9. Body support apparatus comprising a support surface defined by support members, each support member being mounted for movement in a direction substantially normal to the support surface, wherein at least a multiplicity of the support members are so arranged that movement of any one of those support members in a direction substantially normal to the support surface and beyond a threshold distance relative to an adjacent support member causes movement in substantially the same direction of said adjacent support member, there being substantially no movement of said adjacent support member caused by the movement of said any one of those support members when the distance of relative movement is below the threshold distance and .

a plurality of said multiplicity of support members are directly resiliently urged towards an unloaded position in such a way that the return force increases continuously with the distance of the support member from the unloaded position up to a distance at which the return force is a maximum, further including a drive device for driving one or more support members.

10. Apparatus according to any one of claims 1 to 7, 8, or 9, wherein the apparatus/bed is so configured that air is free to pass from immediately beneath the support surface, via an opposite side of the apparatus/bed, to the exterior of the apparatus/bed.

11. Apparatus according to any one of claims 1 to 7, 8, or 9, further including an air moving device, which forces air through the apparatus/bed.

12. Apparatus according to any one of claims 1 to 7, 8, or 9, further including an air moving device, which forces air through the apparatus/bed, wherein the apparatus is so configured that the temperature of the air forced through the apparatus/bed can be controlled.

13. A bed incorporating a body support apparatus according to any one of claims 1, 2, 4, to 7, 8, or 9.

14. A kit of parts including a plurality of modules, each module comprising a support surface defined by support members, each support member being mounted for movement in a direction substantially normal to the support surface, wherein at least a multiplicity of the support members are so arranged that movement of any one of those support members in a direction substantially normal to the support surface and beyond a threshold distance relative to an adjacent support member causes movement in substantially the same direction of said adjacent support member, there being substantially no movement of said adjacent support member caused by the movement of said any one of those support members when the distance of relative movement is below the threshold distance and a plurality of said multiplicity of support members are resiliently urged towards an unloaded position, the modules being so configured that they may be fixed together to form an apparatus according to any one of claims 1 to 7, 8, or 9.

15. A kit of parts according to claim 14, wherein the modules are so configured that the apparatus is formed by fixing the modules together in a single row.

* * * * *